US009976509B2

(12) United States Patent
Ebert et al.

(10) Patent No.: US 9,976,509 B2
(45) Date of Patent: May 22, 2018

(54) INTERNAL COMBUSTION ENGINE HAVING AN ENGINE BACKPRESSURE BRAKE AND A COMPRESSION RELEASE ENGINE BRAKE

(71) Applicant: MAN Truck & Bus AG, München (DE)

(72) Inventors: Christoph Ebert, Nürnberg (DE); Tobias Herrmann, Nürnberg (DE); Adrian Fink, Nürnberg (DE)

(73) Assignee: MAN TRUCK & BUS AG, München (DE)

( * ) Notice: Subject to any disclaimer, the term of this patent is extended or adjusted under 35 U.S.C. 154(b) by 0 days. days.

(21) Appl. No.: 15/388,230

(22) Filed: Dec. 22, 2016

(65) Prior Publication Data

US 2017/0175665 A1 Jun. 22, 2017

(30) Foreign Application Priority Data

Dec. 22, 2015 (DE) ..... 10 2015 016 605

(51) Int. Cl.
*F02D 13/04* (2006.01)
*F01L 13/06* (2006.01)
(Continued)

(52) U.S. Cl.
CPC ..... *F02D 41/3064* (2013.01); *F01L 1/181* (2013.01); *F01L 1/185* (2013.01);
(Continued)

(58) Field of Classification Search
CPC ..... F02D 41/3064; F02D 41/1448; F02D 13/0207; F02D 13/0242; F02D 13/0246;
(Continued)

(56) References Cited

U.S. PATENT DOCUMENTS 5,692,469 A 12/1997 Rammer et al.
6,415,763 B1 * 7/2002 Kobayashi ..... F02D 41/021 123/326
(Continued)

FOREIGN PATENT DOCUMENTS

DE 3923371 C1 6/1990
DE 102012100962 A1 8/2012
(Continued)

OTHER PUBLICATIONS

Extended European Search Report issued in corresponding application No. 16002575.5 dated Apr. 24, 2017.

*Primary Examiner* — Mahmoud Gimie
(74) *Attorney, Agent, or Firm* — Carter, DeLuca, Farrell & Schmidt, LLP

(57) ABSTRACT

An internal combustion engine having at least one outlet valve per cylinder, which outlet valve can be actuated via a camshaft and a transmission device, a hydraulic valve clearance compensation element being arranged in the transmission device between the camshaft and the outlet valve, and having an engine braking device, having an engine backpressure brake for building up an exhaust gas backpressure and a compression release engine brake, by way of which at least one outlet valve can be held open at least in an engine braking phase, the compression release engine brake being formed by the hydraulic valve clearance compensation element.

10 Claims, 3 Drawing Sheets

(51) Int. Cl.

| | |
|---|---|
| ***F02D 41/30*** | (2006.01) |
| ***F02D 13/02*** | (2006.01) |
| ***F02D 41/14*** | (2006.01) |
| ***F01L 1/18*** | (2006.01) |
| ***F01L 1/24*** | (2006.01) |
| ***F02D 9/06*** | (2006.01) |

(52) U.S. Cl.
CPC ..... *F01L 1/2405* (2013.01); *F01L 1/2411* (2013.01); *F01L 13/06* (2013.01); *F01L 13/065* (2013.01); *F02D 9/06* (2013.01); *F02D 13/0207* (2013.01); *F02D 13/0242* (2013.01); *F02D 13/04* (2013.01); *F02D 41/1448* (2013.01); *F02D 2250/34* (2013.01)

(58) Field of Classification Search
CPC .. F02D 13/04; F02D 9/06; F01L 13/06; F01L 13/065
USPC ..... 123/320, 321, 323
See application file for complete search history.

(56) References Cited

U.S. PATENT DOCUMENTS

| | | | | |
|---|---|---|---|---|
| 2010/0258079 | A1* | 10/2010 | Ott | F01L 1/181 123/321 |
| 2013/0319370 | A1* | 12/2013 | Yang | F01L 1/08 123/322 |
| 2016/0169126 | A1* | 6/2016 | Rammer | F02D 9/06 123/90.15 |

FOREIGN PATENT DOCUMENTS

| | | | |
|---|---|---|---|
| EP | 0736672 | A2 | 10/1996 |
| EP | 2143894 | A1 | 1/2010 |
| EP | 2143896 | A1 | 1/2010 |
| WO | 2004/081352 | A1 | 9/2004 |

* cited by examiner

INTERNAL COMBUSTION ENGINE HAVING AN ENGINE BACKPRESSURE BRAKE AND A COMPRESSION RELEASE ENGINE BRAKE

BACKGROUND

1. Technical Field

The present disclosure relates to an internal combustion engine having at least one outlet valve per cylinder, which outlet valve can be actuated via a camshaft and a transmission device, a hydraulic valve clearance compensation element being arranged in the transmission device between the camshaft and the outlet valve, and having an engine braking device, having an engine backpressure brake for building up an exhaust gas back pressure and a compression release engine brake, by way of which at least one outlet valve can be held open at least in an engine braking phase, in particular also in a cam base circle phase.

2. Description of Related Art

Laid open specifications EP 2 143 894 A1 and EP 2 143 896 A1 have disclosed internal combustion engines having engine braking devices and valve clearance compensation mechanisms. Here, in each case one hydraulic valve clearance compensation mechanism is arranged in a valve crosshead. Here, the valve clearance compensation mechanism has a piston which adjoins a pressure space, the pressure space being flow-connected via a check valve to a pressure line which has a constant pressure. A relief line emanates from the pressure space, which relief line opens via a controllable relief valve into an oil outlet opening. Furthermore, a hydraulic additional valve control unit of the engine control device is arranged in the valve crosshead, the control pressure space of which additional valve control unit is flow-connected to the pressure space of the controllable relief valve. The control pressure space is flow-connected via an oil duct to a control pressure line on a counterholder, a counterholder making contact via a stop piston with the valve crosshead on a side which faces away from the outlet valves. As a result of the numerous hydraulic pistons and pressure lines which are arranged in the valve crosshead, high machining and manufacturing complexity of the valve crosshead is required, the valve crosshead being weakened structurally and therefore having to be of correspondingly solid design.

The engine braking devices which are described in the cited documents are in each case a mixed form of an engine backpressure brake and a compression release engine brake, which mixed form is also called, in particular, an EVB ("exhaust valve brake"). Here, the hydraulic additional valve control unit is installed on one side into a valve crosshead of the connecting mechanism, which valve crosshead at the same time actuates two outlet valves. The hydraulic additional valve control unit is fed oil by means of the oil circuit of the respective internal combustion engine which is present in any case. In this type of engine braking devices, the use of hydraulic valve clearance compensation devices requires additional measures, in order to avoid uncontrolled pumping up of the valve clearance compensation device during the engine braking mode, which might lead to serious engine damage. In EP 2 143 894 A1 and EP 2 143 896 A1, this takes place by virtue of the fact that the pressure space of the hydraulic valve clearance compensation device is relieved of pressure during the engine braking mode via a controllable relief valve. The arrangement which is known from the prior art with numerous oil bores and hydraulic pistons in the valve crosshead has the disadvantage that the valve crosshead is weakened structurally and therefore has to be of greater dimensions.

Laid open specification DE 10 2012 100 962 A1 describes a possibility of combining a hydraulic valve clearance compensation means with a relief valve and therefore at the same time implementing an engine braking device and a maintenance-free valve train only by way of a hydraulic valve clearance compensation means. The compression release engine brake is therefore formed by way of the hydraulic valve clearance compensation element. In order to avoid the outlet valve being held open in an undesired manner by way of the hydraulic valve clearance compensation means after the engine braking mode has ended, the following components are also required for a braking mode in addition to the customary components of a hydraulic valve clearance compensation means, however: a relief line with a controllable relief valve including a control line, and a hold-down with a setting screw.

The function of this embodiment is similar to the EVB engine braking device which is described in laid open specifications EP 2 143 894 A1 and EP 2 143 896 A1 and can be described as follows: if the exhaust gas throttle valve is closed, the exhaust gas pressure rises in the outlet duct before the compression (bottom dead centre) to such a pronounced extent that the outlet valve is briefly pressed open by way of the pressure wave of an adjacent cylinder. The piston of the hydraulic valve clearance compensation means which is permanently loaded with engine oil pressure prevents renewed closure of the valve. A small stroke remains, as a result of which a part of the compressed air can already flow out of the cylinder during the compression stroke in the engine. After the top dead centre is reached, the said opening is maintained. The pressure on the piston which then moves downwards is reduced substantially, and the braking performance is improved. As a result of the throttling of the exhaust gas, both the upward and the downward movement of the engine piston can be utilized for braking. At the same time, the relief valve is switched in the engine braking mode, which relief valve opens a relief bore to the high pressure space of the hydraulic valve clearance compensation means. The said relief bore is first of all still closed by way of the holddown, however. At the beginning of the injection stroke, the relief bore is opened by way of the rocker arm movement, the oil escapes and relieves the piston. The "extended" piston of the hydraulic valve clearance compensation means can therefore be reset again and can completely close the outlet valve again.

The abovementioned components are therefore still also necessary for a braking mode in this solution, in the form of the relief line with a controllable relief valve including a control line, and a hold-down with a setting screw, in addition to a classic hydraulic valve clearance compensation means.

SUMMARY

It is therefore an object of the present disclosure to provide both an engine brake and an automatic valve clearance compensation means in an improved manner. The present disclosure is based, in particular, on the object of providing an engine brake and an automatic valve clearance compensation means in a manner which is simpler, less expensive and uses less installation space.

The said objects are achieved by way of an apparatus having the features of the independent claim. Advantageous embodiments and applications of the present disclosure are the subject matter of the dependent claims and will be explained in greater detail in the following description with partial reference to the figures.

According to general aspects of the present disclosure, an apparatus, in particular an internal combustion engine, is provided having at least one outlet valve per cylinder, which outlet valve can be actuated via a camshaft and a mechanical transmission device. Here, a hydraulic valve clearance compensation element is arranged in the transmission device between the camshaft and the outlet valve. The hydraulic valve clearance compensation element can comprise a piston which adjoins a pressure space and an oil pressure line which opens into the pressure space via a check valve which is loaded by way of a spring.

Hydraulic valve clearance compensation elements in the internal combustion engines are known per se and serve, in particular, to compensate for the length dimensions of the gas exchange valves, which length dimensions change over the service life, in such a way that reliable valve closure is ensured in the base circle phase of the cam which actuates the valve. Here, secondly, the cam lift is to be transmitted without loss to the valve and therefore to be converted into a valve stroke movement. The method of operation of hydraulic valve clearance compensation elements of this type which are arranged in the force flow of a valve controller, in particular of an internal combustion engine, will be presumed to be known in the following text.

Furthermore, the internal combustion engine comprises an engine braking device, having an engine backpressure brake which is known per se for building up an exhaust gas back pressure. The engine backpressure brake can comprise, for example, a pressure flap which is arranged in the exhaust gas section and can be controlled or regulated. When the flap is closed, the backpressure is increased on the side which lies counter to the flow direction, and thus provides a braking action which acts on the drive engine of the motor vehicle.

Furthermore, the engine braking device comprises a compression release engine brake, by way of which at least one outlet valve can be held open at least in an engine braking phase. The compression release engine brake is initiated in a gas-controlled manner via the increased exhaust gas backpressure if a braking flap is at least partially closed, in which "valve jump" of the outlet valves is triggered in a targeted manner.

In the present case, one special feature lies in the fact that the compression release engine brake is formed here by the hydraulic valve clearance compensation element. In other words, the engine backpressure brake and the hydraulic valve clearance compensation element are designed in such a way that a sum of the forces which act on the outlet valve lead in the engine braking mode to an open position of the outlet valve. The forces which act on the outlet valve comprise firstly a valve spring force of the outlet valve, a gas pressure force which is produced on the combustion chamber side, which forces act in each case in the closing direction of the outlet valve, a frictional force which acts in the transmission device, and secondly a gas pressure force of the exhaust gas pressure which is produced by the engine backpressure brake, an oil pressure force which is produced by the valve clearance compensation element, and a spring force of the restoring spring of the hydraulic valve clearance compensation element, which forces act in each case in a direction which is opposed to the closing direction. In the engine braking mode, a force which is exerted by the hydraulic valve clearance compensation element therefore acts on the outlet valve together with the gas force of the exhaust gas pressure which is produced by the engine backpressure brake, and leads to the outlet valve being pressed into the open position and/or being held in the open position. The hydraulic valve clearance compensation means therefore assumes a double function. Firstly, a maintenance-free valve train is realised by way of it in a conventional way, and secondly it is used in the engine braking mode for increasing the braking performance, in which at least one outlet valve can be held open by means of the hydraulic valve train in an engine braking phase, with the result that the hydraulic valve train also assumes the function of a compression release engine brake. This saves components and costs.

According to one aspect of the present disclosure the hydraulic valve clearance compensation means can be configured as a classic or conventional hydraulic valve clearance compensation means, that is to say can be provided in the form of a hydraulic valve clearance compensation means which does not have any additional means for making an accelerated pressure relief of the pressure space of the hydraulic valve clearance compensation means possible, in order to make more rapid closure of the outlet valve possible after ending of the engine braking mode.

In order to ensure that the outlet valves are closed again completely after ending of the engine braking mode before the combustion mode, and in order thus to ensure a reliable transition from an engine braking mode into the combustion mode, the internal combustion engine comprises a control device for controlling the fuel injection operation, which control device is configured to restart a fuel injection operation after an end of an engine braking mode only after a predefined lag time has elapsed. Here, the predefined lag time is fixed in such a way that it is greater than a closing time of the outlet valve after ending of the engine braking mode. The combustion mode is therefore not resumed immediately after an end of the engine braking mode, but rather is initiated only after waiting for a lag time.

The closing time of the outlet valve is understood to mean the time period between the opening of the engine backpressure brake, which corresponds to the end of the engine braking mode, and the closed position of the outlet valve which is held open by the hydraulic valve clearance compensation element in the engine braking mode. The closing time can be measured, for example, experimentally on a test bench.

The hydraulic valve clearance compensation element is preferably configured in such a way that a duration of the closing time corresponds substantially to a duration which leakageinduced restoring operation of the deflected piston of the hydraulic valve clearance compensation element lasts, which is triggered at the end of the engine braking mode by way of a reduction in a gas force of the exhaust gas pressure which acts on the outlet valve. This is the case, for example, when the hydraulic valve clearance compensation element does not have any additional means for making an accelerated pressure relief of the pressure space of the hydraulic valve clearance compensation means possible. In the case of a valve clearance compensation element of this type, after the gas force of the exhaust gas pressure has ended, the valve spring and the gas pressure from the combustion space ensure that the hydraulic valve clearance compensation element is pressed back into the starting position again. During "pressing back", oil is pressed out of the high pressure chamber via the leakage gap, which corresponds to a reduction of the oil volume in the high pressure space of the hydraulic valve play compensation means.

According to one embodiment, the decrease of the gas force which is produced by the engine backpressure brake and not a change in the oil force which is produced by the valve clearance compensation element is substantially critical for the return of the outlet valve into the closed position after ending of the engine braking mode, and therefore also for the value of the closing time. A duration of the closing time can thus depend substantially on a reduction of a gas force of the exhaust gas pressure which acts on the outlet valve, which reduction is caused during opening of the engine backpressure brake at the end of the engine braking mode.

According to another embodiment, a relief line which emanates from a pressure space of the valve clearance compensation element and can be connected to a pressure sink via a controllable relief valve is not provided. Furthermore, one variant of the said embodiment provides that a counterholder which is configured to open an outlet opening of the relief line only at the beginning of an outlet stroke is not provided. In particular, a counterholder, against which the transmission device bears in an end position on the preferably adjustable counterholder, is not provided. As a result, costs for the said additional parts and the installation space which is required for this purpose can be saved.

One possible realization according to the present disclosure provides, for example, that the lag time lies in a range from 0.5 to 3 seconds, further preferably in a range from 1 to 2 seconds. Furthermore, the lag time can be stored in the control device or in a memory device which is used by the control device.

In one embodiment, the mechanical transmission device comprises a valve crosshead and a valve lever which is configured as a rocker arm or drag lever, is driven by the camshaft and acts on the outlet valves via the valve crosshead.

According to another embodiment, a piston, a check valve and a spring of the hydraulic valve clearance compensation element can be arranged between the valve lever and the valve crosshead. Depending on the valve train construction, however, other installation locations or designs for the hydraulic valve clearance compensation means are also possible. For example, the hydraulic valve clearance compensation means can be arranged between the push rod and the rocker arm, integrated into a bucket tappet or a valve tappet.

According to a further aspect, furthermore, the present disclosure relates to a motor vehicle, in particular a commercial vehicle, having an internal combustion engine, as described in this document.

BRIEF DESCRIPTION OF THE DRAWINGS

The above-described preferred embodiments and features of the present disclosure can be combined with one another as desired. Further details and advantages of the present disclosure will be described in the following text with reference to the appended drawings, in which.

Identical or functionally equivalent elements are denoted by the same reference numerals in all figures.

DETAILED DESCRIPTION

Figure 1:
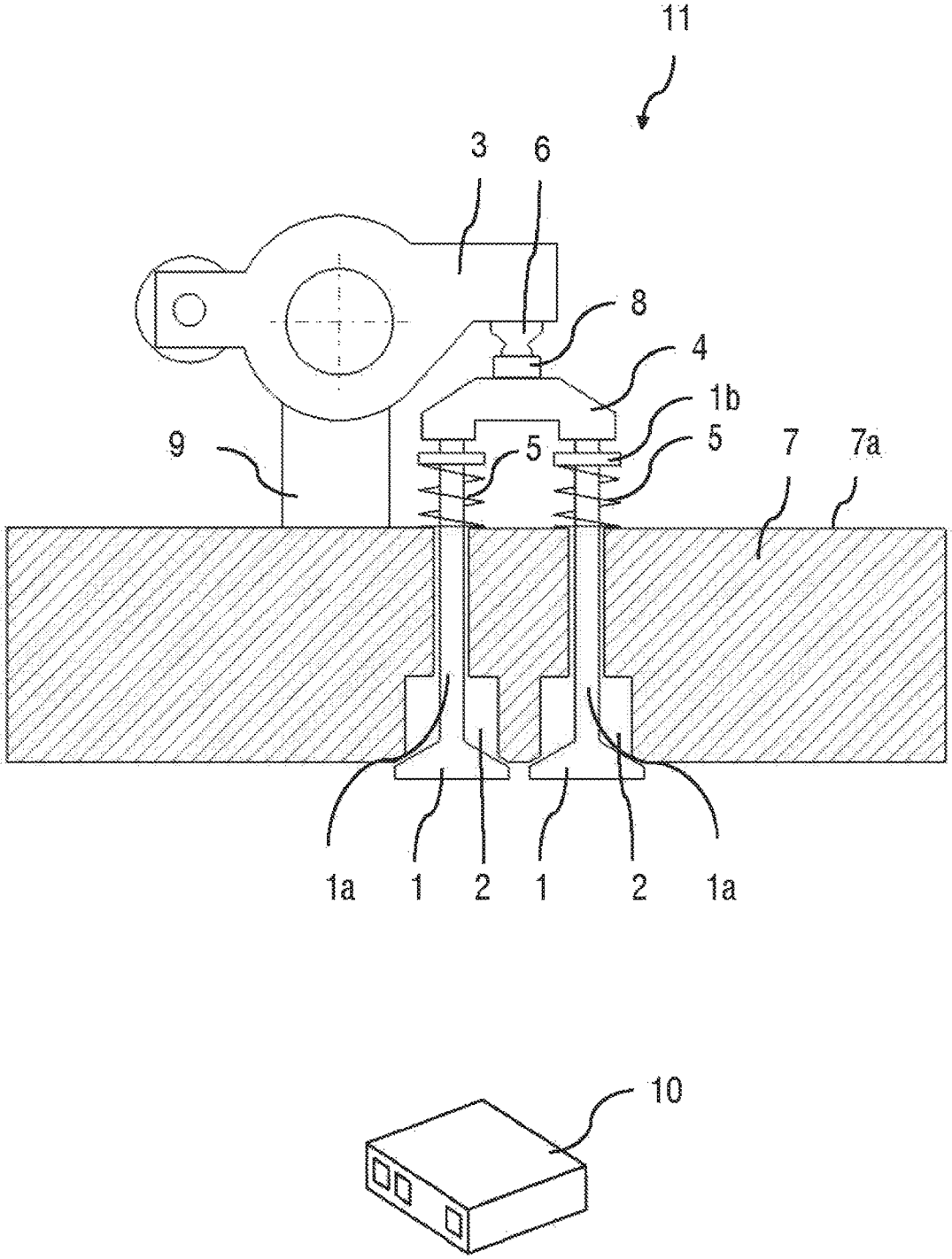
FIG. 1 shows a valve train with a hydraulic valve clearance compensation means according to one embodiment of the present disclosure.

FIG. 1 shows a valve train 11 with a hydraulic valve clearance compensation means 6 of an internal combustion engine according to one embodiment of the present disclosure. The internal combustion engine comprises a 4-stroke reciprocating piston internal combustion engine (not shown) which has at least one inlet valve (not shown) and two outlet valves 1 per cylinder.

The inlet and outlet valves 1 can be controlled by a camshaft (not shown). The camshaft can lie at the bottom or at the top in relation to the rocker arm 3. FIG. 1 corresponds to the version with an overhead camshaft (not shown) in the region of the controller of the two outlet valves 1 of a cylinder. The rocker arm 3 is mounted rotatably on the cylinder head 7 on a bearing block 9 on a bearing axle with a plain bearing. The rocker arm 3 in turn acts on a valve crosshead 4. The said valve crosshead 4 serves to control the two outlet valves 1 of a cylinder (not shown) of the internal combustion engine (not shown), which outlet valves 1 are arranged axially parallel to one another. Each of the outlet valves 1 is mounted axially movably by way of its stem la in the cylinder head 7 (shown in a greatly diagrammatic manner) and is loaded in the closing direction C with a defined prestressing force F3 (see also FIG. 2) by way of a closing spring (restoring spring) 5 which is supported at one end on a cylinder head surface 7*a* and at the other end on a spring collar 1*b* which is fastened to the outlet valve stem 1*a*. Here, each of the two closing springs 5 can be realised either by way of only one helical spring or two helical springs which are coaxial with respect to one another.

A hydraulic valve clearance compensation element 6 is arranged between the rocker arm 3 and the valve crosshead 4, with the result that the rocker arm acts on the valve crosshead 4 and therefore on the outlet valves 1 via the hydraulic valve clearance compensation element 6 and a supporting cap 8 which is articulated in the manner of a ball joint.

The hydraulic valve clearance compensation element 6 which is configured in a manner known per se has a piston which adjoins a pressure space and an oil pressure line which opens into the pressure space via a check valve which is loaded by way of a spring (not shown in each case). The piston, the check valve and the spring of the hydraulic valve clearance compensation element 6 are arranged between the valve lever 3 and the valve crosshead 4.

The hydraulic valve clearance compensation element 6 serves, in particular, to compensate for the wear (the valve works its way into the valve seat) over the engine service life, with the result that reliable valve closure is ensured in the base circle phase of the cam which actuates the outlet valve 1.

The outlet ducts 2 of the cylinders open into an exhaust gas section of the internal combustion engine, into which an engine backpressure brake for building up an exhaust gas backpressure is installed in a manner known per se as close to the engine as possible. The said engine backpressure brake can be formed by a throttle valve or a disc valve or a slide. A throttle valve is used in most cases. Including its control and/or regulating members, the engine backpressure brake forms part of the engine braking device and serves during engine braking operations for shutting off the exhaust gas section at least partially and for backing up the exhaust gas in a manner which is brought about upstream as a result.

A compression release engine brake for increasing the engine braking performance which is formed in the present case by the hydraulic valve clearance compensation element 6 is a further part of the engine braking device.

The function of the hydraulic valve clearance compensation element 6 for increasing the engine braking performance can be described as follows:

If the exhaust gas throttle valve is closed for an engine braking mode, a gas force F5 of the exhaust gas pressure which acts on the outlet valve 1 is built up. Here, the exhaust gas pressure in the outlet duct rises before the compression, in particular during the intake cycle before the bottom dead centre and at the bottom dead centre, to such an extent that the outlet valve 1 is pressed open briefly by way of the pressure wave of an adjacent cylinder, as a result of which in the cam base circle phase a gap is formed between the outlet valve 1 and the valve seat ring and/or an opening to the outlet duct 2 is produced (known as valve springs or valve flaps). The pressing open of the valve is also assisted by a first force component F1 which emanates from the hydraulic valve clearance compensation element 6 as a consequence of the oil pressure, and by a second force component F2 which emanates from the hydraulic valve clearance compensation element 6 as a consequence of the restoring spring.

Pressing open of the outlet valve 1 by way of the two effects which are described leads to a relief of the hydraulic valve clearance compensation element 6 and, on account of the constant prevailing oil pressure and the spring force of the restoring spring of the hydraulic valve clearance compensation element, as a result to adjusting of the hydraulic valve clearance compensation element 6. The piston of the hydraulic valve clearance compensation element therefore extends. Renewed closure of the valve is prevented as a result.

A small gap of the size V1 remains between the outlet valve 1 and the valve seat ring (called the gap for short in the following text), as a result of which part of the compressed air can already flow out of the cylinder during the compression cycle in the engine. The pressure on the piston which subsequently moves downwards again (power stroke) is reduced substantially. The engine braking performance is improved as a result. Both of the upward and the downward movement of the engine piston can be used for braking purposes as a result of the throttling of the exhaust gas.

The gap, which is set between the outlet valve 1 and its valve seat ring in the engine braking mode, is dependent on the following influencing variables:

(a) the exhaust gas pressure which produces the gas force F5 which acts on the outlet valve 1,
(b) the gas pressure from the combustion chamber side, which gas pressure is generated by the gas force F6 which acts in the closing direction C,
(c) the oil pressure which prevails at the hydraulic valve clearance compensation means which generates the oil pressure force F1,
(d) the spring force F2 of the restoring spring of the hydraulic valve clearance compensation means,
(e) the valve spring force F3 of the closing springs 5,
(f) the friction in the valve train, which friction produces a frictional force F4.

Figure 2:
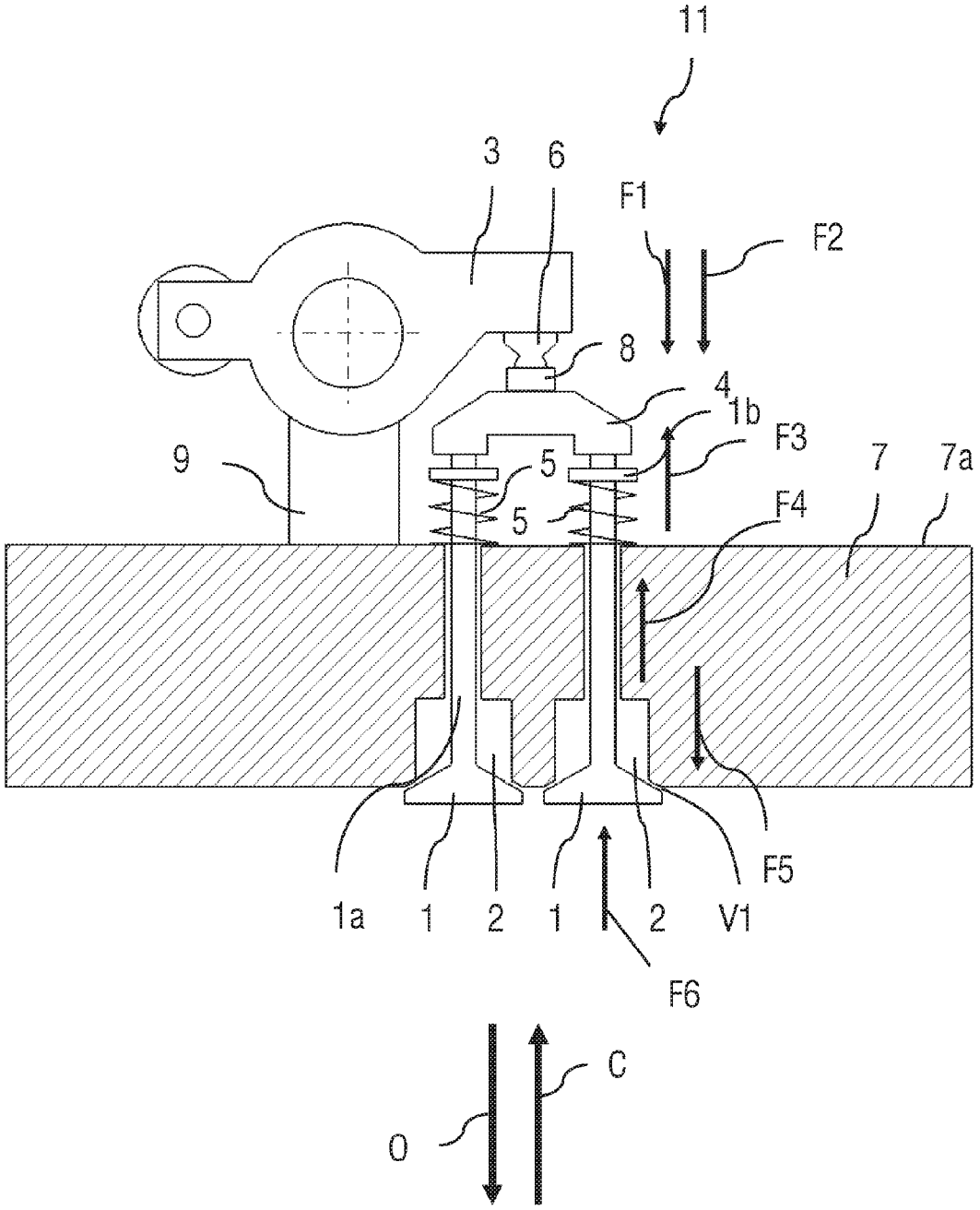
FIG. 2 shows an illustration of the forces which act during the engine braking mode on the outlet valves of the valve train of FIG. 1.
Figure 3:
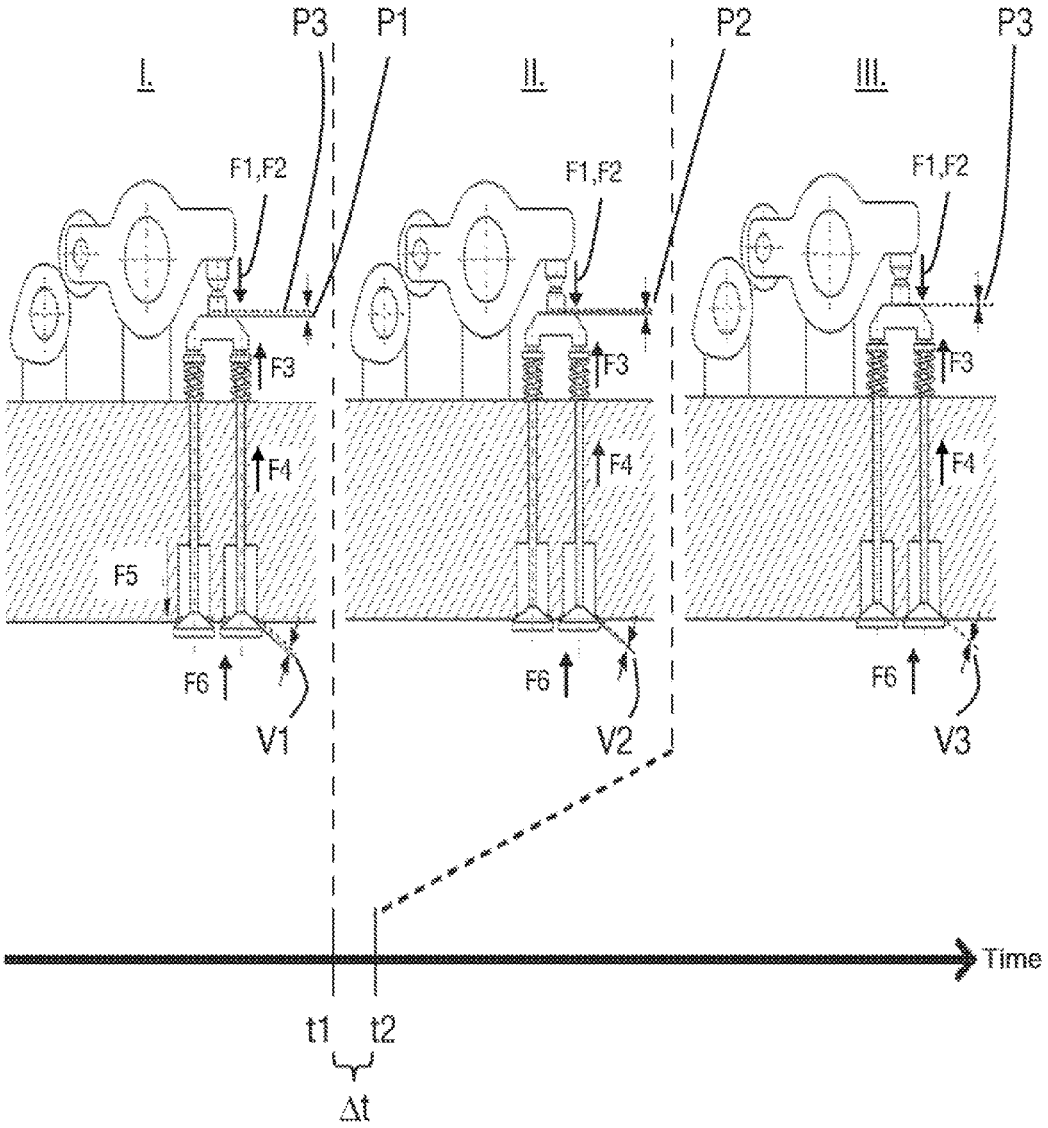
FIG. 3 shows an illustration of the transition from the engine braking mode to the combustion mode according to one embodiment of the present disclosure.

The forces F1 to F6 which act on the outlet valve 1 are shown in FIGS. 2 and 3. The force F5 which is generated by the engine backpressure brake and the forces F1 and F2 which are generated by the valve clearance compensation element all act in the same direction O, that is to say in a direction towards the open position of the outlet valve 1. The spring force F3 of the closing spring 5 (restoring spring) of the outlet valve and the gas force F6 which is generated by the combustion chamber pressure in the cylinder act in the closing direction C of the outlet valve in contrast.

The maximum gap size and the engine speed, above which in each case one gap occurs between the outlet valves 1 and the associated valve seat rings can be influenced by way of adaptation of the said influencing variables and/or forces. The two outlet valves 1 therefore both jump and are held open by the hydraulic valve clearance compensation element 6 which is connected to the two outlet valves 1 via the valve crosshead 4.

An increase in the gap between the outlet valve 1 and the valve seat ring and/or a shift of the occurrence of the gap towards lower engine speeds can be achieved by way of at least one of the following measures: increasing the exhaust gas pressure; reducing the gas pressure from the combustion chamber side; increasing the oil pressure which prevails at the hydraulic valve clearance compensation means; increasing the spring force of the restoring spring of the hydraulic valve clearance compensation means; reducing the valve spring force; or reducing friction in the valve train.

A reduction in the gap and/or a shift of the occurrence of the gap towards higher engine speeds can be achieved in an analogous manner by means of at least one of the following measures: reducing the exhaust gas pressure; increasing the gas pressure from the combustion chamber side; reducing the oil pressure which prevails at the hydraulic valve clearance compensation means; reducing the spring force of the restoring spring of the hydraulic valve clearance compensation means; increasing the valve spring force; or increasing friction in the valve train.

In this way the gap size which is set via the valve clearance compensation element 6 in the engine braking mode and therefore the desired increase in the engine braking performance can be set. The gap always approaches a maximum value at a defined engine speed. The maximum value of the gap is set at an equilibrium of forces of the influencing variables listed above. The said maximum value increases as the engine speed rises.

The method of operation of the engine braking device will be explained using FIG. 3 and, in particular, a transition from an engine braking mode to the subsequent combustion mode will be explained.

The states of the valve train 11 denoted by "I.", "II." and "III." in FIG. 3 in each case show the state of the valve train, in particular the outlet valve position in the cam base circle phase, that is to say the valve lever 3 is not deflected. Here, the "cam base circle phase" is to be understood to mean, in particular, an angular region of the cam unit, in which angular region cam contours of all the part cams of the cam unit assume a common base circle level.

Here, the state I. corresponds to the state of the valve train 11 during an engine braking phase (time period before t1). Here, the state II. corresponds to the state of the valve train 11 during a transition phase from t1 to t2, during which an overrun mode takes place after ending of the engine braking mode, that is to say no injection takes place. Here, the state III. corresponds to the state of the valve train 11 during a combustion mode which begins after a lag phase of duration Δt at the time t2.

The transition from the engine braking mode into the combustion engine mode is a particular challenge. It should be ensured that the outlet valves 1 are closed completely again before the combustion engine mode, in order to prevent increased valve/seat ring wear and/or overloading of the valve train as a result of the outlet valves 1 being open in the combustion mode.

In the braking mode, a maximum value V1 for the gap between the outlet valve 1 and the valve seat ring is set after a certain time, the maximum value being dependent on the engine speed. In this state, the piston of the hydraulic valve clearance compensation element 6 is in the extended state P1, indicated by the solid line P1. The starting position is shown by the dotted line P3.

In this state, the forces of oil pressure force F1, restoring spring force F2 of the hydraulic valve clearance compensation means, gas force F5 of the exhaust gas pressure, valve spring force F3, frictional force F4 and the gas force F6 which is produced by the cylinder chamber pressure are in equilibrium.

This corresponds to state I. of FIG. 3 (time t1). Directly after the engine braking mode is ended at time t1, at which the exhaust gas flap of the engine backpressure brake is opened, the outlet valve 1 is first of all still open on account of the deflected piston of the hydraulic valve clearance compensation element 6.

As a result of the opening of the exhaust gas flap at time t1, however, the gas force F5 of the exhaust gas pressure is greatly reduced suddenly, and therefore the described equilibrium of forces is disrupted. The gas force F6 from the cylinder space and critically the valve spring force F3 then lead to the piston of the hydraulic valve clearance compensation element 6 returning again in the direction of the starting position and the outlet valves 1 being able to close completely again.

This closing time of the outlet valve 1 after ending of the engine braking mode can be measured experimentally in advance on a test bench.

One option for ensuring the complete closure of the outlet valves 1 before the combustion engine operation is a delayed, renewed fuel injection operation with the aid of corresponding parameters of the engine control unit.

To this end, the engine control unit 10 which controls the fuel injection operation is configured to restart a fuel injection operation after an end of an engine braking mode (time t1) only after a predefined lag time Δt has elapsed, the predefined lag time Δt being fixed in such a way that it is greater by a distance value than a previously determined closing time of the outlet valve 1 after ending of the engine braking mode. In the time period t1 to t2, which corresponds to the state II. of the valve train in FIG. 3, the gap between the outlet valve 1 and the valve seat ring therefore has a progressively smaller size V2 and returns finally to the value V3=zero. Accordingly, the piston of the hydraulic valve clearance compensation element 6 retracts again. The outlet valve is closed again before the time t2 is reached. In the time between t1 (end of engine braking mode) and t2=t1+Δt, an overrun mode therefore takes place, and therefore no injection takes place. This ensures that the piston of the hydraulic valve clearance compensation element 6 has sufficient time to retract and the outlet valve 1 has sufficient time to close. In the state II. of FIG. 3, an intermediate position P2 of the piston of the hydraulic valve clearance compensation element 6 is shown, in which intermediate position P2 said piston has almost retracted again back into the starting position P3.

At the time t2, the piston of the hydraulic valve clearance compensation element 6 is situated in the starting position P3 again. The gap size V3 is zero, that is to say the outlet valve 6 is closed again. At the time t2, the engine control unit 10 then starts the combustion mode again.

According to this embodiment, it can therefore be avoided that a hydraulic valve clearance compensation element is combined with a relief line with a controllable relief valve including a control line and a hold-down with a setting screw. Instead, the transition from the engine braking mode to the combustion mode is controlled in such a way that the combustion mode starts after ending of the engine braking mode only after a lag time which is selected in such a way that the outlet valve is given sufficient time to move into the closed position.

Although the present disclosure has been described with reference to defined exemplary embodiments, a person skilled in the art can see that various amendments can be performed and equivalents can be used as a replacement, without departing from the scope of the present disclosure. In addition, a large number of modifications can be carried out without departing from the associated scope. As a result, the present disclosure is not to be limited to the disclosed exemplary embodiments, but rather is to comprise all exemplary embodiments which fall within the scope of the appended patent claims. In particular, the present disclosure also claims protection for the subject matter and the features of the subclaims regardless of the claims which are referred to.

LIST OF REFERENCE NUMERALS

1 Outlet valve
1*a* Stem
1*b* Spring collar
2 Outlet duct
3 Rocker arm
4 Valve crosshead
5 Closing spring
6 Valve clearance compensation element
7 Cylinder head
7*a* Cylinder head surface
8 Supporting cap
9 Bearing block
10 Control device, e.g. engine control unit
11 Valve train
t1 End of engine braking mode
t2 Start of combustion mode
Δt lag time
F1 Oil pressure force of the hydraulic valve clearance compensation element
F2 Spring force of the hydraulic valve clearance compensation element
F3 Spring force of the closing spring
F4 Frictional force
F5 Gas force by way of the engine backpressure brake
F6 Gas force by way of the combustion chamber pressure in the cylinder
V1, V2, V3 Gap size between the outlet valve and the

We claim:

1. An internal combustion engine comprising:

at least one outlet valve in communication with a cylinder, the outlet valve actuated via a camshaft and a transmission device;

a hydraulic valve clearance compensation element arranged in the transmission device between the camshaft and the outlet valve;

an engine braking device, including an engine backpressure brake for building up an exhaust gas backpressure and a compression release engine brake, by way of which at least one outlet valve can be held open at least in an engine braking phase, wherein the compression release engine brake is formed by the hydraulic valve clearance compensation element;

a control device for controlling the injection of fuel which is configured to restart a fuel injection operation after an end of an engine braking mode only after a predefined lag time (Δt) has elapsed, the predefined lag time (Δt) being fixed in such a way that it is greater than a closing time of the outlet valve (1) after ending of the engine braking mode.

2. The internal combustion engine according to claim 1, wherein the hydraulic valve clearance compensation element includes a piston which adjoins a pressure space and an oil pressure line which opens into the pressure space via a check valve which is loaded by way of a spring.

3. The internal combustion engine according to claim 2, wherein a relief line which emanates from the pressure space of the valve clearance compensation element and can be connected to a pressure sink via a controllable relief valve is not provided.

4. The internal combustion engine according to claim 3, wherein a counterholder which is configured to open an outlet opening of the relief line only at the beginning of an outlet stroke is not provided.

5. The internal combustion engine according to claim 2, wherein the hydraulic valve clearance compensation element is configured in such a way that a duration of the closing time corresponds substantially to a duration of a leak-induced restoring operation of the deflected piston of the hydraulic valve clearance compensation element, which restoring operation is triggered at the end of the engine braking mode by way of a reduction of a gas force of the exhaust gas pressure which acts on the outlet valve.

6. The internal combustion engine according to claim 1, wherein the lag time (Δt) lies in a range from 0.5 to 3 seconds, further preferably in a range from 1 to 2 seconds.

7. The internal combustion engine according to claim 1, wherein the lag time (Δt) is stored in the control device or in a memory device which is used by the control device.

8. The internal combustion engine according to claim 1, wherein the transmission device comprises:

(a) a valve crosshead; and (b) a valve lever which is configured as a rocker arm or drag lever, is driven by the camshaft and acts on the outlet valves via the valve crosshead.

9. The internal combustion engine according to claim 2, wherein the piston, the check valve and the spring of the hydraulic valve clearance compensation element are arranged between the valve lever and the valve crosshead.

10. A motor vehicle, in particular a commercial vehicle, comprising:

at least one outlet valve in communication with a cylinder, the outlet valve actuated via a camshaft and a transmission device;

a hydraulic valve clearance compensation element arranged in the transmission device between the camshaft and the outlet valve;

an engine braking device, including an engine backpressure brake for building up an exhaust gas backpressure and a compression release engine brake, by way of which at least one outlet valve can be held open at least in an engine braking phase, wherein the compression release engine brake is formed by the hydraulic valve clearance compensation element; and a control device for controlling the injection of fuel which is configured to restart a fuel injection operation after an end of an engine braking mode only after a predefined lag time (Δt) has elapsed, the predefined lag time (Δt) being fixed in such a way that it is greater than a closing time of the outlet valve (1) after ending of the engine braking mode.

* * * * *